US005566798A

United States Patent [19]

Tsai

[11] Patent Number: 5,566,798

[45] Date of Patent: Oct. 22, 1996

[54] TRUNK WITH A CONCEALABLE RETRACTABLE HANDLE

[76] Inventor: Cheng-Hsien Tsai, No. 103, Da-Ming 1st Rd., Tien-Tzu Hsiang, Taichung Hsien, Taiwan

[21] Appl. No.: 499,923

[22] Filed: Jul. 10, 1995

[51] Int. Cl.[6] ..... A45C 13/04; A45C 13/26

[52] U.S. Cl. ..... 190/115; 190/39; 190/122; 190/127; 16/115

[58] Field of Search ..... 190/122, 127, 190/39, 115, 18 A; 280/37, 655, 655.1; D3/279; 16/115

[56] References Cited

U.S. PATENT DOCUMENTS

| | | | |
|---|---|---|---|
| D. 364,504 | 11/1995 | Bieber et al. | D3/279 X |
| 2,716,473 | 8/1955 | Droutman | 190/127 |
| 4,383,142 | 5/1983 | Kaneko | 190/126 |
| 4,433,760 | 2/1984 | Pelavin | 190/126 X |
| 4,784,248 | 11/1988 | Workman | 190/126 |
| 5,167,306 | 12/1992 | Carrigan, Jr. | 190/115 X |
| 5,197,579 | 3/1993 | Bieber et al. | 190/18 A |
| 5,295,565 | 3/1994 | Latshaw | 190/111 X |
| 5,350,046 | 9/1994 | Falloon et al. | 190/127 X |
| 5,377,795 | 1/1995 | Berman | 190/18 A |
| 5,393,079 | 2/1995 | Wang | 190/18 A X |
| 5,431,262 | 7/1995 | Rekuc et al. | 190/127 X |
| 5,431,263 | 7/1995 | Nordstrom | 190/18 A |
| 5,431,428 | 7/1995 | Marchwiak et al. | 280/655 |
| 5,474,162 | 12/1995 | Shyr et al. | 190/18 A |
| 5,482,147 | 1/1996 | Wang | 190/18 A X |

FOREIGN PATENT DOCUMENTS

| | | | |
|---|---|---|---|
| 1288078 | 9/1972 | United Kingdom | 190/122 |

*Primary Examiner*—Sue A. Weaver
*Attorney, Agent, or Firm*—Bacon & Thomas

[57] ABSTRACT

A trunk includes a trunk body reinforced by a lining and a supporting frame on the inside and defines a storage chamber. The trunk body includes a top notch, a front cover covering the storage chamber at one side, a metal frame fastened around the periphery of the storage chamber at an opposite side relative to the front cover, and a back cover fixedly fastened to the metal frame and coveting the storage chamber opposite to the front cover. The metal frame has a top recessed portion defining, with the top notch, a handle mounting space. A handle mounting frame assembly is mounted in the handle mounting spaced and includes an upper handle holder and a bottom handle holder. The bottom handle holder includes a recessed portion and the upper handle holder includes a recessed portion fitted into the recessed portion on the bottom handle holder. A retractable handle is mounted within the recessed portion on the upper handle holder when retracted and is provided with two downward parallel sliding rods adapted to be moved in and out of respective coupling holes provided on the handle holder frame assembly.

6 Claims, 3 Drawing Sheets

TRUNK WITH A CONCEALABLE RETRACTABLE HANDLE

BACKGROUND OF THE INVENTION

The present invention relates to trunks for travelers for holding clothes, and relates more particularly to such a trunk which comprises a handle holder frame assembly mounted in a recessed space at the top side of the trunk body around the border, and a retractable handle fastened to the handle holder frame assembly, and when not in use, received within a recessed portion on the upper handle holder of the handle holder frame assembly.

A variety of trunks have been disclosed for travelers for holding clothes, and have appeared on the market. These trunks commonly comprise a trunk body having a fixed back cover and a re-openable front cover, and a carrying handle fixedly secured at the top side for carrying by hand. As the carrying handle is fixedly secured in place at the top, it occupies much installation space. When the trunk falls to the ground or is hit by an object during its delivery, the carrying handle may be damaged.

SUMMARY OF THE INVENTION

The present invention has been accomplished to provide a handle for a trunk which can be placed out of sight and well protected when it is not in use.

According to the preferred embodiment of the present invention, the trunk comprises a trunk body reinforced by a lining and a supporting frame on the inside and defining a storage chamber. The trunk body includes a top notch, a front cover covering the storage chamber at one side, a cloth covered metal frame fastened around the periphery of the storage chamber at an opposite side relative to the front cover, a back cover fixedly fastened to the cloth covered metal frame and covering the storage chamber opposite to the front cover The cloth covered metal frame has a top recessed portion defining with the top notch a handle mounting space. A handle mounting frame assembly is mounted in the handle mounting space and includes an upper handle holder and a bottom handle holder, the bottom handle holder having a recessed portion, the upper handle holder having a recessed portion fitted into the recessed portion on the bottom handle holder. A retractable handle is mounted within the recessed portion on the upper handle holder with two downward parallel sliding rods being movable in and out of respective coupling holes on the handle holder frame assembly. When the sliding rods of the retractable handle are completely inserted into the coupling holes, the handle is received within the recessed portion on the upper handle holder and protected by it.

DETAILED DESCRIPTION OF THE PREFERRED EMBODIMENT

Figure 1:
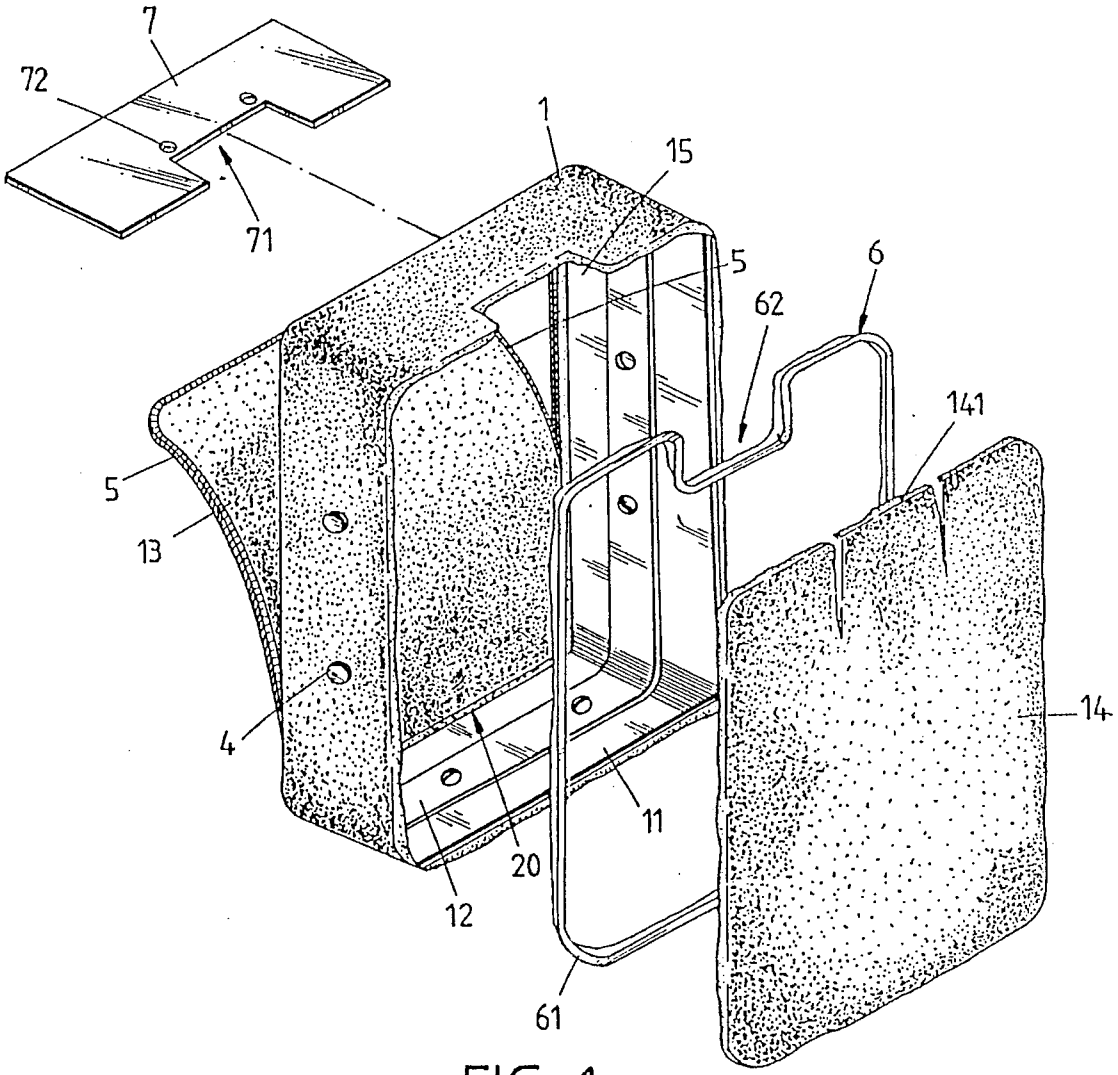
FIG. 1 is an exploded view of a trunk according to the present invention (the retractable handle and the handle holder frame assembly not shown)
Figure 2:
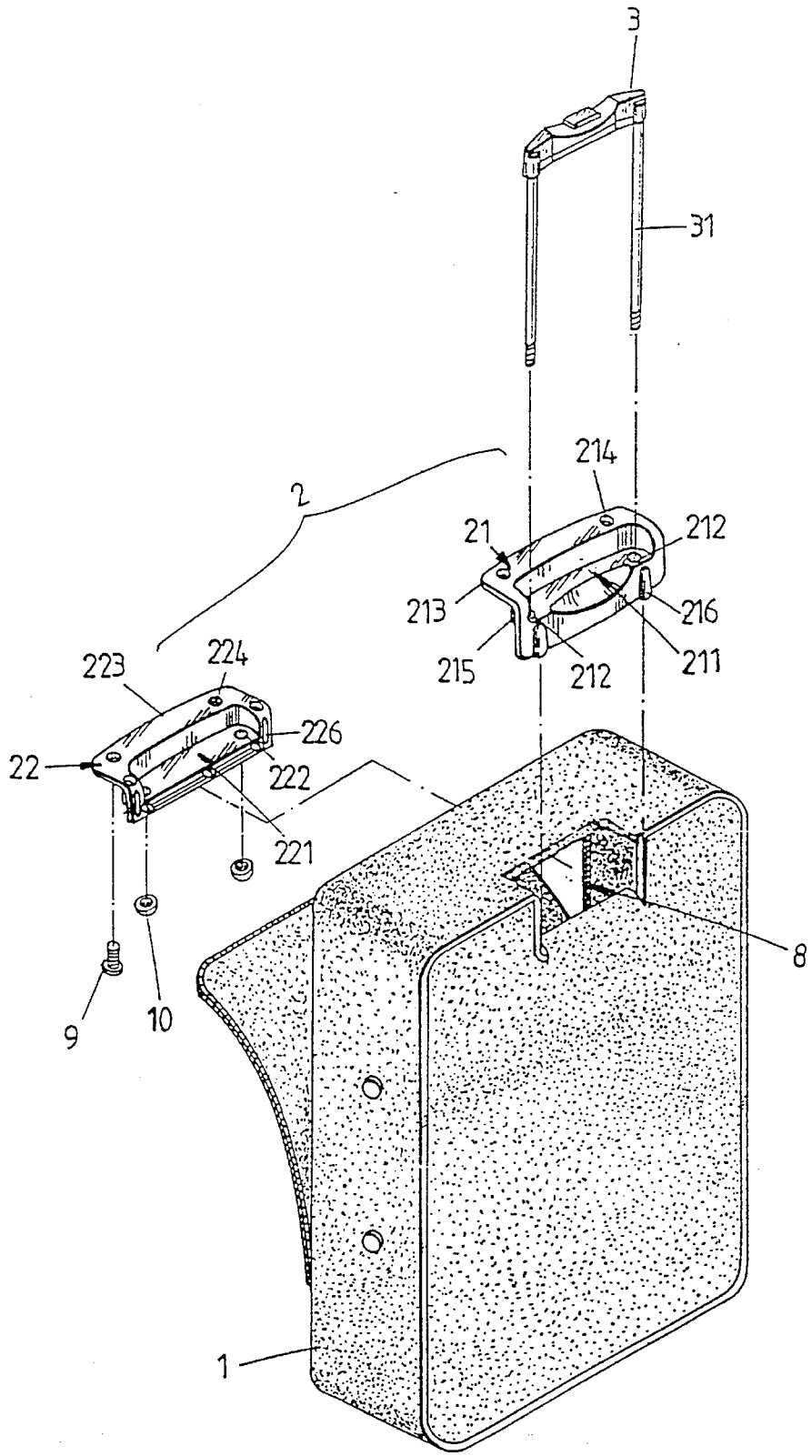
FIG. 2 is another exploded view of the trunk of the present invention, showing the structure of the retractable handle and the handle holder frame assembly.

Referring to FIGS. 1 and 2, a trunk in accordance with the present invention is generally comprised of a trunk body 1, a handle holder frame assembly 2, and a retractable handle 3.

Referring to FIG. 1 again, the trunk body 1 comprises a lining board 11 on the inside around the periphery reinforced by a supporting frame 12 to support the soft covering of the trunk body 1 and defining a storage chamber 20, and a top notch 15 at a suitable location. A top reinforcing plate 7 is fixed between the lining board 11 and the supporting frame 12 at the top side, having a notch 71 matched with the top notch 15 on the top side of the trunk body I and a plurality of mounting holes 72 respectively fastened to the lining board 11 and the supporting frame 12. A front cover 13 is fixed to the trunk body 1 and re-openably covered on the storage chamber 20 at one side by a zip fastener 5. A metal frame 6 is fastened to the periphery of the trunk body 1 at one side opposite to the front cover 13 and covered with a leather covering 61, having a recessed portion 62 at the top side spaced below the top notch 15 on the trunk body 1. A fabric back cover 14 is fastened to the metal frame 6 and covers the storage chamber 20 at an opposite side relative to the front cover 13, having a fly flap 141 cut from the top side thereof corresponding to the recessed portion 62.

Referring to FIG. 2 again, the handle holder frame assembly 2 is mounted within the space 8 defined between the top notch 15 on the trunk body 1 and the recessed portion 62 of the metal frame 6. The handle holder frame assembly 2 includes an upper handle holder 21 and a bottom handle holder 22. The upper handle holder 21 comprises a recessed portion 211, two vertical coupling holes 212 bilaterally disposed through the recessed portion 21i, an outward mounting flange 213, and two vertical mounting holes 214 bilaterally disposed through the outward mounting flange 213. The bottom handle holder 22 comprises a recessed portion 221, two vertical coupling holes 222 bilaterally disposed through the recessed portion 221, an outward mounting flange 223, and two vertical mounting holes 224 bilaterally disposed through the outward mounting flange 223. The vertical mounting holes 224 on the bottom handle holder 22 and the vertical mounting holes 214 on the upper handle holder 21 are respectively and vertically aligned with the mounting holes 72 on the top reinforcing plate 7. The retractable handle 3 comprises two parallel sliding rods 31. The distance between the sliding rods 31 is equal to the pitch between the vertical coupling holes 212 on the upper handle frame 21 and the pitch between the vertical coupling holes 222 on the bottom handle frame 22.

The assembly process of the trunk is outlined hereinafter with reference to FIGS. 1, 2, and 3 again. The lining board 11 and the supporting frame 12 are fixedly secured to the inside wall of the trunk body 1 by rivets 4, permitting the top reinforcing plate 7 to be fixedly secured between the lining board 11 and the supporting frame 12 at the top side to support the top side of the trunk body 1. The back cover 14 and the metal frame 6 are then fastened to the back side of the trunk body 1 by stitches, permitting the fly flap 141 of the back cover 14 to be inwardly folded up and covered over the recessed portion 62 on the metal frame 6 and then fixed in place by stitches. Thereafter, the upper handle holder 21 and the bottom handle holder 22 are respectively mounted in the space 8 defined between the top notch 15 on the trunk body 1 and the recessed portion 62 of the metal frame 6, permitting the top reinforcing plate 7 to be retained between the upper handle holder 21 and the bottom handle holder 22. Then the vertical mounting holes 214 of the upper handle holder 21 and the vertical mounting holes 224 of the bottom handle holder 22 are respectively fastened to the mounting holes 72 on the top reinforcing plate 7 by fastening elements 9 (the mounting holes 214 and 224 can be screw holes, and the fastening elements 9 can be screws). Finally then the two parallel sliding rods 31 of the retractable handle 3 are inserted into the vertical coupling holes 212 on the upper handle holder 21 and the vertical coupling holes 222 on the bottom handle holder 22, and then a respective cap nut 10 is respectively threaded onto the threaded bottom end of each sliding rod 31 of the retractable handle 3 to prevent the retractable handle 3 from falling out of the handle holder frame assembly 2.

Referring to FIG. 2 again, locating grooves 216 and 226 are respectively made on the upper handle holder 21 and the bottom handle holder 22 for engagement with the metal frame 6. Therefore, the positioning of handle holder frame assembly 2 in the space 8 is assured. Two coupling rods 215 may be made on the outward mounting flange 213 at the bottom for connection to the vertical mounting holes 224 on the bottom handle holder 22 by fastening elements 9.

Figure 3:
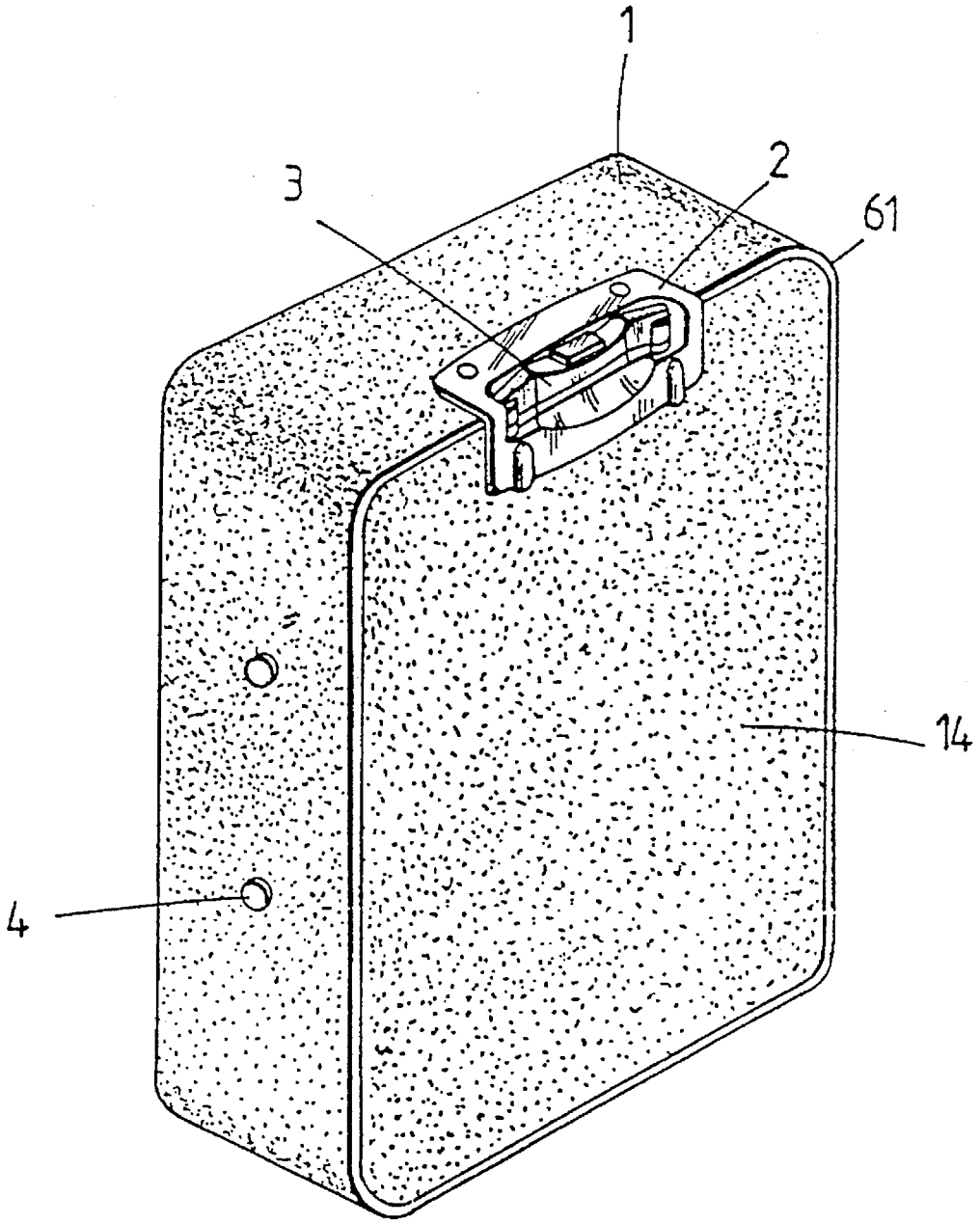
FIG. 3 is an elevational view of the trunk shown in FIG. 1, showing the retractable handle collapsed.

Referring to FIG. 3, when the retractable handle 3 is not used, it is received in the recessed portion 211 on the upper handle holder 21 with its sliding rods 31 completely inserted into the vertical coupling holes 212 and 222, and therefore the retractable handle 3 is concealed from sight and protected by the handle holder frame assembly 2.

it is to be understood that the drawings are designed for purposes of illustration only, and are not intended as a definition of the limits and scope of the invention disclosed.

I claim:

1. A trunk comprising: a trunk body reinforced by a lining and a supporting frame on the inside and defining a storage chamber, said trunk body including a top notch, a front cover covering said storage chamber at one side, a metal frame fastened around the periphery of said storage chamber at an opposite side relative to said front cover, a back cover fixedly fastened to said metal frame and covering said storage chamber on a side opposite to said from cover, said metal frame having a top recessed portion defining, with said top notch, a handle mounting space;

a handle mounting frame assembly mounted in said handle mounting space, said handle mounting frame including an upper handle holder and a bottom handle holder, said bottom handle holder having a recessed portion, said upper handle holder having a recessed portion fitted into the recessed portion on said bottom handle holder; and handle means mounted to said handle mounting frame assembly for movement between an extended position and a retracted position wherein a handle of said handle means is located within the recessed portion of said upper handle holder.

2. The trunk of claim 1 further comprising a top reinforcing plate positioned between the lining and the supporting frame of said trunk body, said upper handle holder and said bottom handle holder being secured to said top reinforcing plate, said top reinforcing plate having a notch matched with the top notch on said trunk body.

3. The trunk of claim 2 wherein said top reinforcing plate has a plurality of mounted holes; said upper handle holder has an outward mounting flange attached to said trunk body and said top reinforcing plate at an outer side and a plurality of mounting holes extending through the outward mounting flange of said upper handle holder corresponding to the mounting holes on said reinforcing plate, said bottom handle holder has an outward mounting flange attached to said trunk body and said top reinforcing plate at an inner side and a plurality of mounting holes extending through the outward mounting flange of said bottom handle holder said upper and bottom handle holders being connected to said reinforcing plate by fastening elements extending through the mounting holes on said reinforcing plate and the mounting holes on both said upper and bottom handle holders.

4. The trunk of claim 3 wherein the mounting holes on said top reinforcing plate, said upper handle holder and said bottom handle holder are screw holes, and said fastening elements are screws.

5. The trunk of claim 1 wherein said upper handle holder and said bottom handle holder have respective locating grooves respectively engaged with said metal frame.

6. The trunk of claim 1 wherein said upper handle holder and said bottom handle holder have a respective pair of coupling holes through the respective recessed portions; said handle means including two parallel sliding rods respectively inserted through the coupling holes on said upper handle holder and said bottom handle holder, each said sliding rods having a threaded terminal end having connected thereto a respective cap nut.

* * * * *